US005772829A

United States Patent [19]

Cowger

[11] Patent Number: 5,772,829

[45] Date of Patent: Jun. 30, 1998

[54] PEN BODY EXHIBITING OPPOSING STRAIN TO COUNTER THERMAL INWARD STRAIN ADJACENT FLEX CIRCUIT

[75] Inventor: Bruce Cowger, Corvallis, Oreg.

[73] Assignee: Hewlett-Packard Company, Palo Alto, Calif.

[21] Appl. No.: 806,189

[22] Filed: Feb. 25, 1997

Related U.S. Application Data

[62] Division of Ser. No. 516,270, Aug. 17, 1995.

[51] Int. Cl.[6] ..... B41J 2/175

[52] U.S. Cl. ..... 156/291; 29/832; 347/87

[58] Field of Search ..... 156/291, 306.9; 29/611, 832; 347/87, 63, 67, 49, 50, 58

[56] References Cited

U.S. PATENT DOCUMENTS

| | | | |
|---|---|---|---|
| 5,189,787 | 3/1993 | Reed et al. | 29/831 |
| 5,506,608 | 4/1996 | Marler et al. | 347/18 |

FOREIGN PATENT DOCUMENTS

| | | |
|---|---|---|
| 594310 A2 | 9/1993 | European Pat. Off. . |
| 646463 A2 | 10/1994 | European Pat. Off. . |
| 646466 A2 | 10/1994 | European Pat. Off. . |
| WO9508910 | 3/1995 | WIPO . |

OTHER PUBLICATIONS

"Adhesive Material And Equipment Selection For The HP DeskJet 500C/Desk Writer C Color Print Cartridge"; Douglas J. Reed & Terry M. Lambright; Aug. 1992; Hewlett–Packard Journal; vol. 43, No. 4; pp. 84–86.

"Automated Assembly Of The HP DeskJet 500C/Desk Writer C Color Print Cartridge"; Lee S. Mason & Mark C. Huth; Aug. 1992; Hewlett–Packard Journal; vol. 43; No. 4; pp. 77–83.

*Primary Examiner*—Daniel Stemmer

[57] ABSTRACT

An inkjet pen is formed by a pen body, flex circuit and silicon substrate. The pen body includes a first arm and a second arm upon which the substrate rests. The flex circuit is attached to the substrate and to regions of the pen body. Contact between the substrate and the arms define fulcrum points for the arms. The first arm and second arm are forced to rotate about their respective fulcrums during thermal expansion and thermal contraction. During cooling, the rotational force counters a contractive force along the pen body region contacting the flex circuit. The countering force reduces the degree of contraction by the pen body. Without such counter-force component the pen body contracts more than the flex circuit imposing a compressive tension of the flex circuit. With such counter-force, the compressive tension is reduced or eliminated. As such compressive force was the source of buckling in prior configurations, circuit, such buckling source is eliminated.

6 Claims, 2 Drawing Sheets

PEN BODY EXHIBITING OPPOSING STRAIN TO COUNTER THERMAL INWARD STRAIN ADJACENT FLEX CIRCUIT

This is a divisional of copending application Ser. No. 08/516,270 filed on Aug. 17, 1995.

BACKGROUND OF THE INVENTION

This invention relates generally to inkjet pen body construction, and more particularly, to thermal dynamics of an inkjet pen formed by a pen body, silicon substrate and flex circuit.

Conventional inkjet printers include inkjet pens which eject ink drops onto a print media to form characters and other symbols. Ink is stored within a pen body and emitted through nozzles in a printhead. The printhead is formed by a silicon substrate and laminated flex circuit. The substrate is attached to the pen body and defines nozzle chambers. The flex circuit is attached to the substrate and the pen body. The flex circuit includes nozzle openings through which ink drops are ejected.

During construction of an inkjet pen, the components undergo a wide variation in temperature. Typically a flex circuit is first adhered to the silicon substrate via a barrier film. Portions of both the flex circuit and substrate then are adhered to the pen body. To adhere the portions of the flex circuit to the pen body, the adjacent structures are heated to approximately 130° C. The elevated temperature cures a structural adhesive bonding the flex circuit to the pen body. After curing, the pen is cooled to room temperature.

A problem experienced during the construction of an inkjet pen is that the flex circuit tends to buckle and/or delaminate from the pen body as the pen is cooled to room temperature. Such buckling and delamination is a result of differences in thermal coefficients of expansion ("TCE") among the pen body, flex circuit and substrate. Typically the pen body is made from plastic, the flex circuit is made from polyimide, and the substrate is made from silicon—three different materials with three different TCE values. Specifically, as the structures are heated, the local area of the pen body expands more than the local area of the flex circuit. Once the adhesive cures, the relative positions of the pen body and flex circuit are fixed. During subsequent cooling, the local area of the pen body contracts more than the local area of the flex circuit. Thus, the flex circuit is left under a compressive tension. Either immediately or over a period of time, the tension causes the flex circuit to buckle. The buckling, in turn, causes delamination. Accordingly, there is need of a construction which avoids or counters undesirable thermally-induced tensions.

SUMMARY OF THE INVENTION

According to the invention, an inkjet pen body defines fulcrum points causing a rotational motion during thermal contraction which counters a compressive motion acting on an attached flex circuit. An inkjet pen is formed by the pen body, flex circuit and a silicon substrate. The substrate and flex circuit are attached to the pen body during construction. According to one method, the component temperatures are elevated during construction so as to cure an epoxy. Once cured the flex circuit and substrate are fixed relative to the pen body. Because the pen body has a significantly higher thermal coefficient of expansion, the pen body contracts more than the flex circuit and substrate during cooling. Because the flex circuit is flexible, buckling has occurred in conventional pens at the contact between the pen body and flex circuit. Specifically, because the flex circuit and pen body area are attached, the greater compression by the pen body imposes a compressive tension at the adjacent flex circuit.

According to one aspect of the invention, the contraction of the pen body along the contact region with the flex circuit is reduced to reduce or eliminate the compressive force imposed on the flex circuit.

According to another aspect of the invention, the contraction of the pen body along the contact region is reduced by a rotational force which has a force component opposing the pen body's contractive force. As a result, the net force imposed by the contracting pen body onto the adjacent flex circuit is reduced or eliminated.

According to another aspect of the invention, the pen body defines an opening into which the substrate is placed during assembly. The substrate rests on a first arm and a second arm portion of the pen body. A contact location between the substrate and first arm defines a fulcrum for the first arm. A contact location between the substrate and the second arm defines a fulcrum for the second arm. The substrate is a substantially rigid body which expands and contracts less than the pen body. As a result, the arms are forced to rotate about the fulcrum during heating and cooling stages of the pen construction process. Specifically, the first arm and second arm rotate during the cooling stage in a manner imposing a component force in the region adjacent to the flex circuit which partially counters the pen body's contractive force.

According to another aspect of the invention, the reduced contractive force approximates the contractive force of the cooling flex circuit. Thus, the pen body and flex circuit once attached contract to a similar degree in their contact region during cooling. As a result, the compressive tension acting on the flex circuit in prior pens is reduced or eliminated.

One advantage of the invention is that the reduced or eliminated compressive tension is insufficient to cause buckling. By eliminating buckling, a significant source of flex circuit delamination is eliminated. A meritorious effect is that fewer pens are found to be defective during construction and later use. Another meritorious effect is that flex circuit openings remain aligned with the underlying nozzles during an extended life of the pen.

These and other aspects and advantages of the invention will be better understood by reference to the following detailed description taken in conjunction with the accompanying drawings.

DESCRIPTION OF SPECIFIC EMBODIMENTS

Flex Circuit Buckling in Conventional Inkjet Pens

Figure 1:
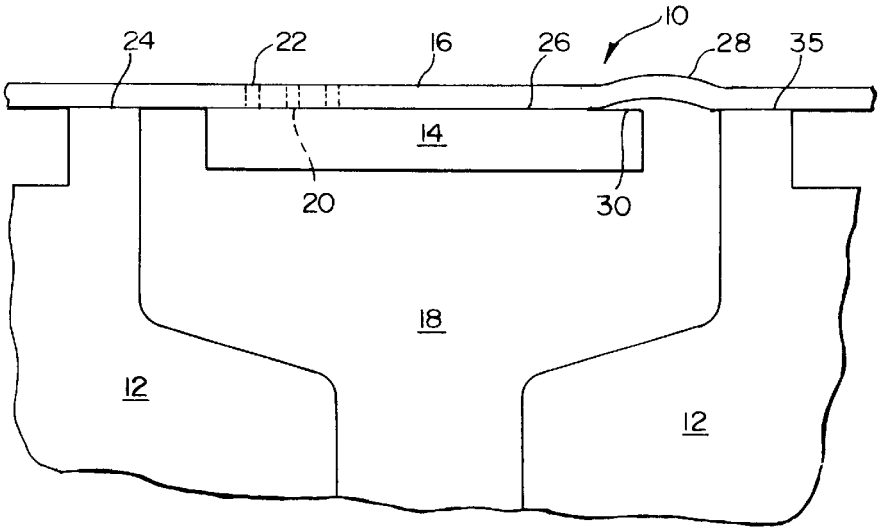
FIG. 1 PRIOR ART
FIG. 1 is a partial cross-sectional view of the printhead region of a conventional inkjet edge-feed pen exhibiting buckling of the flex circuit.

FIG. 1 shows the printhead region of a conventional inkjet edge-feed pen 10. The term edge-feed refers to feeding ink to an edge of the printhead. The pen 10 includes a pen body 12, silicon substrate 14, and flex circuit 16. During operation, ink flows from into channel 18 and through to printhead nozzles 20. The nozzles are defined by the silicon substrate 14 and flex circuit 16. When a nozzle is fired, ink is ejected through a nozzle opening 22 to a print media sheet.

Figure 2:
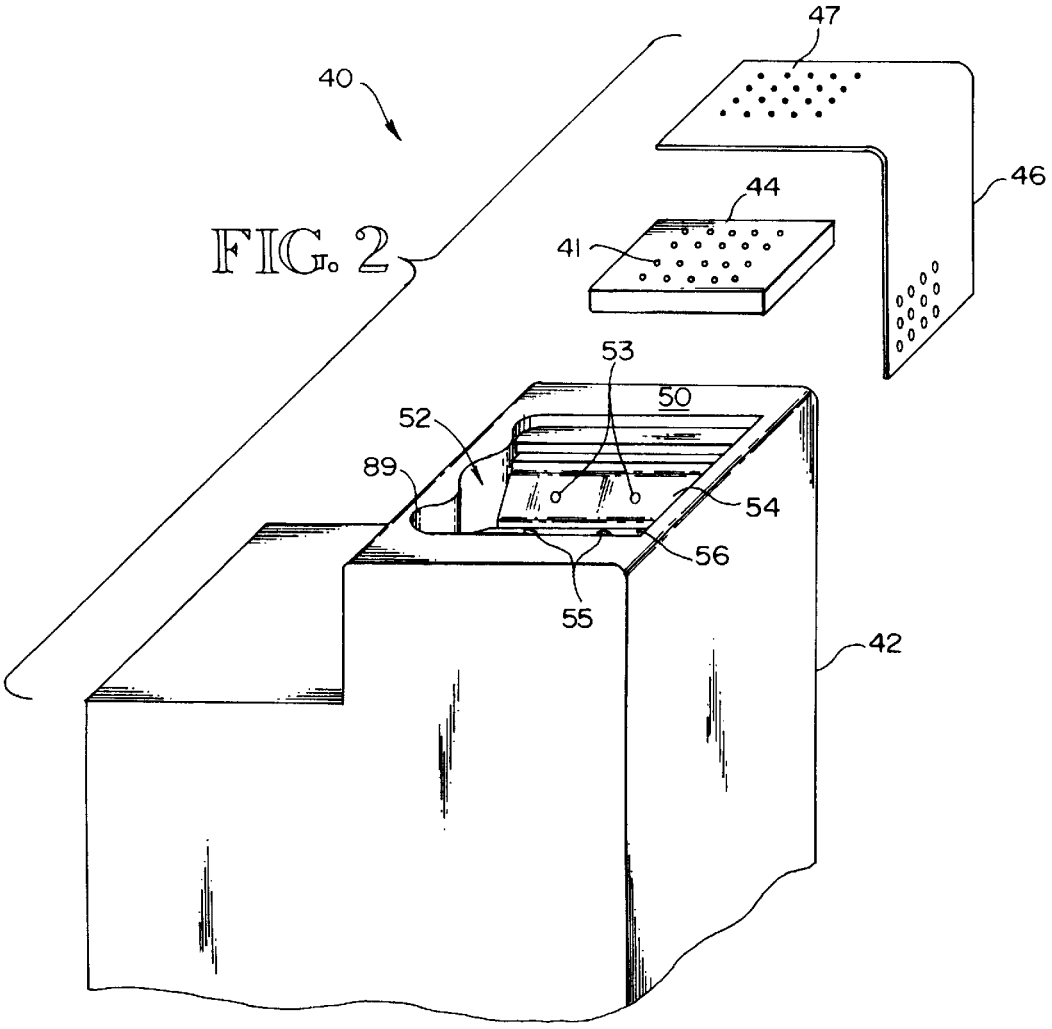
FIG. 2 is an exploded perspective view of an inkjet edge-feed pen according to an embodiment of this invention.

During construction, the flex circuit 16 is attached to the silicon substrate 14. The flex circuit 16 and substrate 14 then are attached to the pen body 12. As described in the background section, the pen body 12, substrate 14 and flex circuit 16 are heated to cure an adhesive (e.g., an epoxy). The thermal dynamics occurring during cooling generate compressive forces along the plane of the flex circuit 16 in the locally attached areas 24–26. During cooling or at some later time the compressive forces cause buckling in the flex circuit 16. In such instances, the compressive forces also are referred to herein as "buckling forces". The ensuing buckling typically leads to delamination of the flex circuit 16. FIG. 1 shows buckling at reference number 28 and delamination at reference number 30. The problem is particularly significant in instances in which the buckling 28 and/or delamination 30 does not occur immediately, but occurs later during packaging, distribution or use of the pen 10. Inkjet Pen Structure for Countering Buckling Forces FIG. 2 shows an exploded view of an inkjet edge-feed pen 40 according to one embodiment of this invention. The pen 40 includes a pen body 42, silicon substrate 44 and flex circuit 46. The pen body 42 is formed of a rigid plastic material, (e.g., polysulfone). Preferably, the pen body 42 is monolithically defined by plastic mold injection. Alternative processes, shapes and constructions also are used. The silicon substrate 44 is a rigid body fabricated using integrated circuit technologies to define printhead nozzles, firing resistors and conductive leads. The printhead nozzle chambers 41. The flex circuit 46 is a flexible member, which in one embodiment is formed from a base material made of polyimide or other flexible polymer material (e.g., polyester, poly-methylmethacrylate), along with conductive paths made of copper, gold or other conductive material. The flex circuit 46 with the base material, conductive paths and bonding slots is available from the 3M Company of Minneapolis, Minn. The flex circuit 46 includes nozzle openings 47.

The pen body 42 includes a planar surface 50 defining an opening 52. A first arm 54 and a second arm 56 define walls within the opening 52. Each arm 54, 56 has openings for allowing ink to pass. To maintain rigidity the arms 54, 56 are ribbed in some embodiments. The first arm 54 and second arm 56 are fixed relative to each other at a distal region 57 (See FIG. 3). In one embodiment the fixed region 57 embodies a "living hinge" which allows the two arms 54, 56 to rotate relative to each other. In another embodiment the two arms 54, 56 are separate but held together to define the region 57 about which the arms 54, 56 can rotate. Each arm 54, 56 extends from the region 57 to or in the proximity of a contact region with the flex circuit 46.

Figure 3:
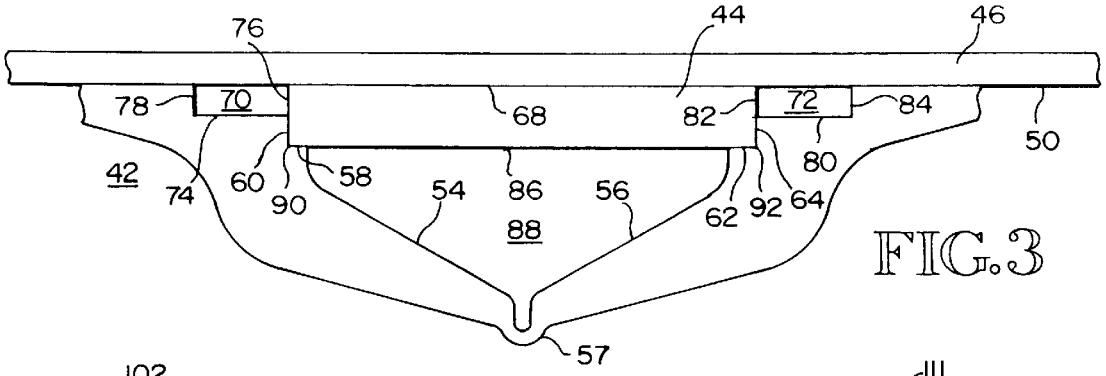
FIG. 3 is a cross-sectional view of the printhead region of the inkjet edge-feed pen of FIG. 2

Referring to FIG. 3, a ledge 58 and barrier 60 are defined along the first arm 54, and a ledge 62 and barrier 64 are defined along the second arm 56. The silicon substrate 44 rests on the ledges 58, 62 and is bound by the barriers 60, 64. During assembly the silicon substrate is attached to the ledges 58, 62 and barriers 60, 64. Preferably, the substrate 44 fits snugly to the ledge/barrier seats. In one embodiment, the barriers are spaced slightly closer than the length of the substrate 44. Thus, during assembly, arms 54, 56 are spread to fit the substrate 44 in place. In a preferred embodiment, the substrate 44 extends from the ledges 58, 62 approximately flush to the opening 52 at the planar surface 50. The flex circuit 46, thus, is able to define a plane adjacent to the planar surface 50 and the outer edge 68 of the substrate 44.

Respective chambers 70, 72 are defined at each side of the silicon substrate 44. Chamber 70 is bound by the flex circuit 46 at one boundary, by a wall portion 74 at an opposing second boundary, by a surface 76 of substrate 44 at an adjacent third boundary, and by a wall portion 78 at an adjacent fourth boundary. Similarly, Chamber 72 is bound by the flex circuit 46 at an one boundary, by a wall portion 80 at an opposing second boundary, by a surface 82 of substrate 44 at an adjacent third boundary, and by a wall portion 84 at an adjacent fourth boundary.

A manifold chamber 88 is defined by the arms 54, 56 and the undersurface 86 of the substrate 44. Ink flows from a storage reservoir (not shown) in the pen body 42 through openings 53, 55 in arms 54, 56 into the manifold 88. Ink flows from the manifold 88 through channels into chambers 70, 72. The ink then flows from the chambers 70, 72 into respective nozzles. Sidewalls 89 (See FIG. 2) of the pen body 42 are corrugated in one embodiment inducing little constraint on the arms 54, 56. Alternative, designs and shapes are used in other embodiments to minimize side-wall or other constraint on the arms 54, 56.

The mating of the substrate 44 to the respective ledge/barrier combinations along the first arm 54 and second arm 56 generates a pair of fulcrums. More specifically, a fulcrum line 90 occurs where ledge 58 and barrier 60 meet and a fulcrum line 92 occurs where ledge 62 and barrier 64 meet. These lines 90, 92 also correspond to the lines where substrate surfaces 76 and 86 meet and where substrate surfaces 82 and 86 meet. Arm 54 levers about the fulcrum 90. Arm 56 levers about the fulcrum 92.

Each arm 54, 56 has a thick portion adjacent to the fulcrum 90, 92 which thins along the arm toward the fixed portion 57. Each arm 54, 56 also thins from the fulcrum 90, 92 to the contact region between the pen body 42 and flex circuit 46. Because the substrate is a rigid body, the fulcrum lines 90, 92 tend to limit the movement of the first arm 54 and second arm 56. As a result, thermal forces occurring in the arms 54, 56 cause arm rotation about the fulcrums 90, 92. The fulcrums 90, 92 also offset slightly due to thermal forces in the substrate 44. It is the rotation of arms 54, 56 which counter the compressive forces acting upon the flex circuit 46.

Assembly and Thermal Dynamics

Using known assembly methods, the substrate 44 and flex circuit 46 are attached to the pen body 42 with an adhesive epoxy. In one embodiment the epoxy is cured at an elevated temperature of approximately 130° C. The final assembly method for attaching substrate 44 and circuit 46 to pen body 42 includes a heating stage and cooling stage. According to the invention, the compressive forces occurring during the cooling stage are countered so as to avoid buckling forces at the flex circuit 46.

Figure 4:
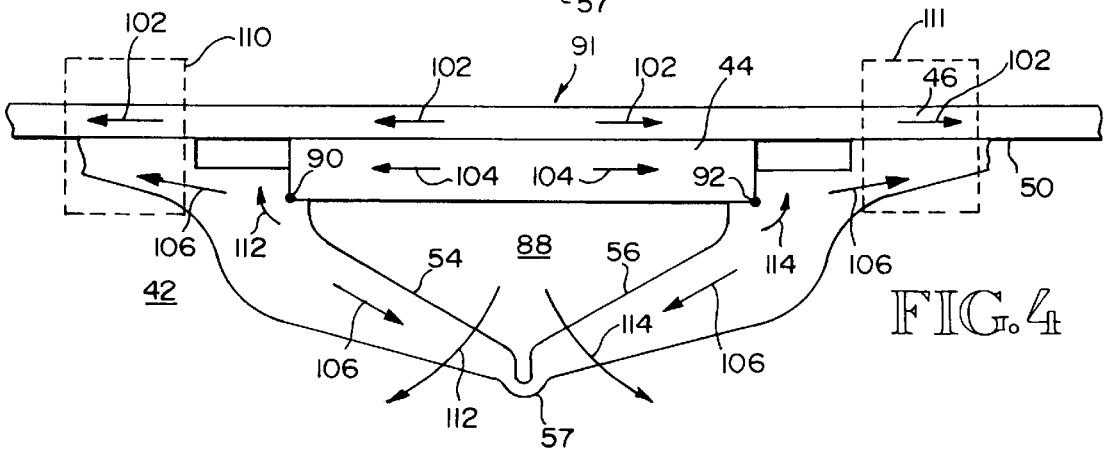
FIG. 4 is a view of the printhead region of FIG. 3 showing thermal dynamics during heating.

FIG. 4 shows the printhead region 91 of the pen 40 during the heating stage. The elevated temperature causes internal expansion forces 102 in the flex circuit 46, internal expansion forces 104 in the substrate 44 and internal expansion forces 106 in arms 54, 56. A typical thermal coefficient of expansion (TCE) for the polyimide flex circuit 46 is approximately 15–20 ppm/°C. A typical thermal coefficient of expansion (TCE) for the silicon substrate 44 is approximately 5 ppm/°C. A typical thermal coefficient of expansion (TCE) for the plastic arms 54, 56 is 100 ppm/°C., but ranges between 50 ppm/°C. and 200 ppm/°C. Using fillers, the TCE for the plastic is reduced in alternative embodiments to approximately 35 ppm/°C. Because the TCE values differ significantly, the pen components expand different amounts. The plastic pen body has the highest TCE and thus expands the most.

Within region 110 of FIG. 4, the flex circuit 46 contacts the pen body 42 via an epoxy adhesive (not shown). Because the pen body has a higher TCE value, the pen body 42 portion in region 110 expands more than the flex circuit 46 portion during the heating stage. Before the epoxy cures, the flex circuit 46 is able to move relative to the pen body 42. Thus, the flex circuit 46 offsets along the planar surface 50 during the heating stage. Similar thermal dynamics occur at other areas in which the flex circuit 46 and pen body 42 are attached, (e.g., region 111). Because the arms 54, 56 have a higher TCE value than the silicon substrate 44, the expansion of arms 54, 56 produces a net force causing rotation of the arms 54, 56 about their respective fulcrum lines 90, 92. A clockwise force 112 acts upon arm 54, while a counter-clockwise force 114 acts upon arm 56.

Once the epoxy cures, the pen body 42, substrate 44 and flex circuit 46 are fixed relative to each other at the epoxy adhering points. Thus, the flex circuit 46 portions in regions 110, 111 are fixed relative to the pen body 42 portions in the same regions 110, 111.

Figure 5:
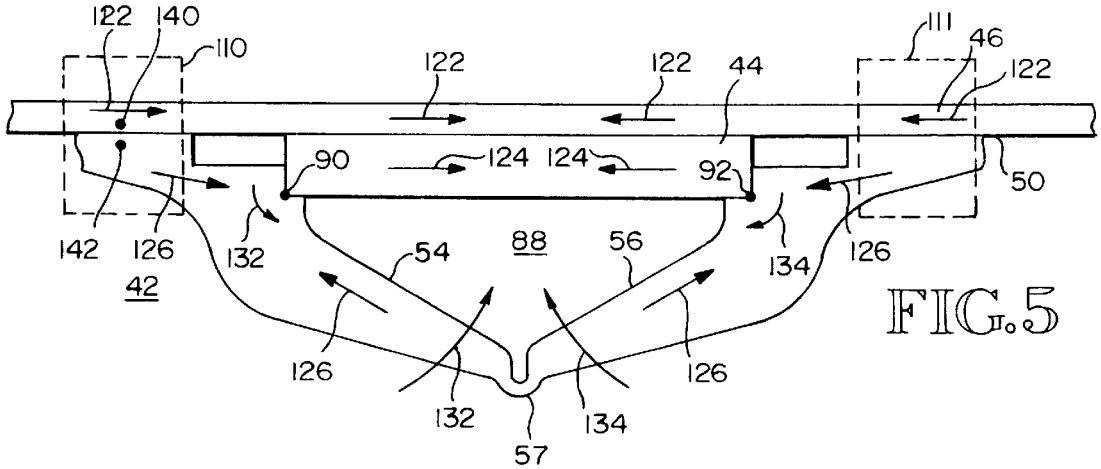
FIG. 5 is a view of the printhead region of FIG. 3 showing thermal dynamics during cooling.

After curing, the cooling stage commences to bring the pen 40 to room temperature. FIG. 5 shows the printhead region of the pen 40 during the cooling stage. The decreasing temperature causes internal contraction forces 122 in the flex circuit 46, internal contraction forces 124 in the substrate 44 and internal contraction forces 126 in the pen body 42 and arms 54, 56. Because the TCE values differ significantly, the pen components contract by different amounts. The plastic pen body has the highest TCE and thus contracts the most.

Within region 110 of FIG. 4, the flex circuit 46 is now adhered to the pen body 42 via the epoxy adhesive. Because the pen body 42 has a higher TCE value, the pen body 42 portion in region 110 contracts more than the flex circuit 46 portion. Similar thermal dynamics occur at other areas in which the flex circuit 46 and pen body 42 are attached, (e.g., region 111). It is because of these differences in contraction lengths that buckling forces occur in prior art pens 10.

Figure 6:
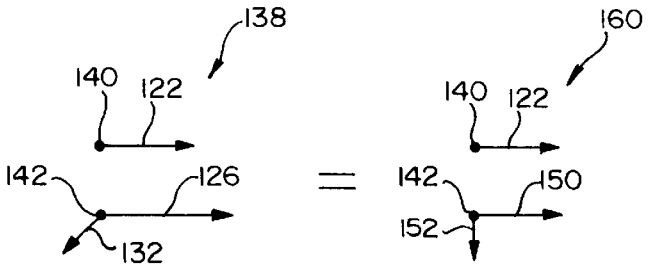
FIG. 6 is a force diagram of compressive forces occurring at a point on the flex circuit and a point on the pen body during cooling.

According to the invention, however, the arms 54, 56 cause countering forces to reduce the compressive forces acting on the flex circuit 46 in regions 110, 111. because the arms 54, 56 have a higher TCE value than the silicon substrate 44, the contraction of arms 54, 56 produce net forces causing rotation of the arms 54, 56 about their respective fulcrums 90, 92. Thus, a counter-clockwise force 132 acts upon arm 54 during cooling, while a clockwise force 134 acts upon arm 56. The significance of the rotational forces 132, 134 becomes apparent in FIG. 6. FIG. 6 is force diagram 138 showing the contractive force 122 acting upon a point 140 located on a portion at flex circuit 46 within region 110. Force diagram 138 also shows the contractive force 126 and rotational force 132 acting upon a nearby point 142 located on a portion of arm 54 within region 110. Reducing the forces 126 and 132 acting on the arm 54 to components orthogonal to the flex circuit 46 contractive force 122 results in an equivalent force diagram 160. Force diagram 160 shows a force 150 acting on point 142 which is parallel to the force 122 acting on point 140. Force diagram 160 also shows a force 152 acting on point 142 which is perpendicular to the force 122 acting on point 140. Of significance is the parallel component force 150. The parallel component force 150 is the contractive force 126 less the opposing component of the rotational force 132. Thus, the rotational force 132 counters some of the contractive force 126 at the arm 54 portion within region 110. As a result, the parallel force component 150 is reduced by the arm rotation causing the arm 54 to contract less than it would without the rotational force. Ideally, the rotational force 132 counters enough of the contractive force 126 so that force 150 is approximately equal to force 122. In such case, the length of contraction of pen body 42 within the contact regions 110, 111 will approximate the length of contraction of flex circuit 46 within the contact regions 110, 111. In a preferred embodiment, the rotational force 132 counters at least enough of the contractive force 126 that any resulting compressive force acting on the flex circuit 46 is insufficient to cause buckling. Specifically the resulting compressive force, if any, does not cause buckling when the pen 42 cools or thereafter, during the desired useful lifetime of the pen 40.

To achieve a sufficient rotational countering force, the arms 54, 56 are elongated (from a cross-sectional view such as shown in FIGS. 3–5), and have a thicker portion in the vicinity of the fulcrum lines 90, 92 than at the portions along the arm away from the fulcrum. In one embodiment the arms 54, 56 taper from the respective fulcrum to a hinge portion 57 at which the arms merge. Also, the arms 54, 56 become thinner (from the cross-sectional view such as shown in FIGS. 3–5) from the fulcrums toward the regions 110, 111, respectively. In addition, each arm 54 extends at one angle from the fulcrum 90, 92 to the hinge area 57 and at another angle from the fulcrum 90, 92 to the contact region 110, 111. By having a "bent" arm 54, 56, thermal contraction yields a greater countering component to the contractive force of the pen body in contact regions 110, 111. According to exemplary embodiments, the angle of the bend in each arm 54, 56 is between 135° and 180°, inclusive, and preferably between 150° and 180°, inclusive. The actual bend is prescribed based upon the thermal coefficients of expansion (e.g., of body 42, substrate 44, and flex circuit 46), substrate 44 width and channel 70, 72 widths.

By knowing (i) the TCE values for the flex circuit 46 and arms 54, 56, (ii) the elevated temperature at the time of curing and (iii) an approximate room temperature, one can experimentally derive arm 54, 56 lengths and shapes which achieve the desired countering force.

In a specific embodiment, the substrate 44 has a length of 5.0 mm and a thickness of 1.0 mm. Each chamber 70, 72 adjacent the substrate 44 has a width of 1.0 mm. For a change in temperature of 120° C. and thermal coefficient of TCE=56, TCE=20, TCE=4.7, the following results were obtained:

chamber 70, 72 thermal strain=0.00396 mm/mm arm 54, 56 thermal strain 0.005643 mm/mm arm height (height component of arm length)=3.56 mm arm rotation=0.00396 radians=0.23 degrees.

The arm height is independent of temperature as expected. The temperature change induces arm rotation. In this example, the 0.23 degrees of rotation suffices to eliminate any buckling potential imposed on the flex circuit 46.

Meritorious and Advantageous Effects

One advantage of the invention is that the reduced or eliminated compressive tension is insufficient to cause buckling. By eliminating buckling, a significant source of flex circuit delamination is eliminated. A meritorious effect is that fewer pens are found to be defective during construction and later use. Another meritorious effect is that flex circuit openings remain aligned with the underlying nozzles during an extended life of the pen.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method of constructing an inkjet pen to withstand thermal strain occurring at a region of contact between an arm of a pen body and a first member, the inkjet pen including the pen body, the first member, a second member and a third member, the pen body having a surface and an opening, the opening being adjacent to the surface, the pen body having said arm, a portion of the arm serving as a wall within the opening, the arm having a first end, a second end, and an intermediary seat, the first end forming a portion of the pen body surface adjacent to the opening, the second member being rigid, the third member located within the pen body opening, the second end of the arm being fixed to the third member, and wherein the pen body has a first thermal coefficient of expansion, the first member has a second thermal coefficient of expansion, and the second member has a third thermal coefficient of expansion, the first thermal coefficient of expansion greater than the second thermal coefficient of expansion and the third thermal coefficient of expansion, the method comprising the steps of:

mounting the rigid second member within the opening at both the intermediary seat of the arm and to the third member;

adhering the first member to the pen body surface at the first end of the arm to provide the region of contact between the pen body arm and the first member;

adhering the first member to the second member;

undergoing at the arm thermal contraction during a reduction in temperature which causes rotation of the arm about the seat, the seat serving as a fulcrum between the second member and the arm;

undergoing at the pen body and the first member thermal contraction during the reduction in temperature, the thermal contraction of the pen body and the first member occurring at the region of contact; and imposing a force by the arm during the rotation of the arm which counters the thermal contraction of the pen body at the pen body surface within the region of contact, the force reducing a difference in thermal contraction between the pen body and the first member within the region of contact due to a difference between the first thermal coefficient of expansion and the second thermal coefficient of expansion.

2. A method of constructing an inkjet pen to withstand thermal strain occurring at a region of contact between an arm of a pen body and a first member, the inkjet pen including the pen body, the first member, a substrate, and a second member, the pen body having a surface and an opening, the opening being adjacent to the surface, the pen body having said arm, a portion of the arm serving as a wall within the opening, the arm having a first end, a second end, and an intermediary seat, the first end forming a portion of the pen body surface adjacent to the opening, the second member located within the pen body opening, the second end of the arm being fixed to the second member, and wherein the pen body has a first thermal coefficient of expansion, the first member has a second thermal coefficient of expansion, and the substrate has a third thermal coefficient of expansion, the first thermal coefficient of expansion greater than the second thermal coefficient of expansion and the third thermal coefficient of expansion, the method comprising the steps of:

mounting the substrate within the opening at both the intermediary seat of the arm and to the second member;

adhering the first member to the pen body surface at the first end of the arm to provide the region of contact between the pen body arm and the first member;

adhering the first member to the substrate;

undergoing at the arm thermal contraction during a reduction in temperature which causes rotation of the arm about the seat, the seat serving as a fulcrum between the substrate and the arm;

undergoing at the pen body and the first member thermal contraction during the reduction in temperature, the thermal contraction of the pen body and the first member occurring at the region of contact; and imposing a force by the arm during the rotation of the arm which counters the thermal contraction of the pen body at the pen body surface within the region of contact, the force reducing a difference in thermal contraction between the pen body and the first member within the region of contact due to a difference between the first thermal coefficient of expansion and the second thermal coefficient of expansion.

3. A method for maintaining alignment of inkjet nozzle chambers to inkjet nozzle openings in an inkjet pen during changes in temperature, the inkjet pen including a pen body, a flexible circuit member, and a substrate, the substrate defining the nozzle chambers, the flexible circuit member defining the nozzle openings, the pen body having a surface and an opening, the opening being adjacent to the surface, the pen body having a first lever arm and a second lever arm, a portion of the first lever arm serving as a first wall within the opening, a portion of the second lever arm serving as a second wall within the opening, the first lever arm having a first end, a second end, and an intermediary seat, the first end forming a first portion of the pen body surface adjacent to the opening, the second lever arm having a first end, a second end, and an intermediary seat, the first end of the second lever arm forming a second portion of the pen body surface adjacent to the opening, the second end of the first lever arm being fixed relative to the second end of the second lever arm, and wherein the pen body has a first thermal coefficient of expansion, the flexible circuit member has a second thermal coefficient of expansion, and the substrate has a third thermal coefficient of expansion, the first thermal coefficient of expansion greater than the second thermal coefficient of expansion and the third thermal coefficient of expansion, the method comprising the steps of:

mounting the substrate within the opening at both the intermediary seat of the first lever arm and the intermediary seat of the second lever arm;

adhering the flexible circuit member to the pen body surface at the first end of the first lever arm to provide a first region of contact between the pen body and the flexible circuit member, and adhering the flexible circuit member to the pen body surface at the first end of the second lever arm to provide a second region of contact between the pen body and the flexible circuit member;

adhering the flexible circuit member to the substrate with the inkjet nozzle chambers of the substrate aligning with the inkjet nozzle openings of the flexible circuit member;

undergoing, at the first lever arm and second lever arm, thermal contraction during a reduction in temperature which causes rotation of the first lever arm about the first lever arm's intermediary seat and which causes rotation of the second lever arm about the second lever arm's intermediary seat, the first lever arm's seat serving as a fulcrum between the substrate and the first lever arm, the second lever arm's seat serving as a fulcrum between the substrate and the second lever arm;

undergoing at the pen body and the flexible circuit member thermal contraction during the reduction in temperature, the thermal contraction of the pen body and the flexible circuit member occurring at the first region of contact and the second region of contact;

imposing a first force by the first lever arm during the rotation of the first lever arm which counters the thermal contraction of the pen body at the pen body surface within the first region of contact, the first force reducing a difference in thermal contraction between the pen body and the flexible circuit member within the first region of contact due to a difference between the first thermal coefficient of expansion and the second thermal coefficient of expansion; and imposing a second force by the second lever arm during the rotation of the second lever arm which counters the thermal contraction of the pen body at the pen body surface within the second region of contact, the second force reducing a difference in thermal contraction between the pen body and the flexible circuit member within the second region of contact due to a difference between the first thermal coefficient of expansion and the second thermal coefficient of expansion.

4. The method of claim 3, wherein for a reduction in temperature of not more than 120° C., the first force and the second force reduce the thermal contraction which occurs within the pen body to prevent the thermal contraction within the pen body from imposing a buckling force on the flexible circuit member, the first force and the second force thereby eliminating such thermal contraction as a source of misalignment between the flexible circuit member nozzle openings and the substrate nozzle chambers.

5. The method of claim 3, wherein the first lever arm second end is hinged relative to the second lever arm second end.

6. The method of claim 3, in which the first lever arm has a first portion extending from the first lever arm intermediary seat toward an area hinged with the second lever arm and a second portion extending from the first lever arm intermediary seat toward the first contact region, the first portion and second portion oriented at an angle between approximately 150° and approximately 180°.

* * * * *